US010046902B2

(12) United States Patent
Thompson et al.

(10) Patent No.: US 10,046,902 B2
(45) Date of Patent: Aug. 14, 2018

(54) SMART BIN LOTTERY TICKET DISPENSER WITH DUAL TEAR BARS

(71) Applicant: Scientific Games International, Inc., Newark, DE (US)

(72) Inventors: Mark Andrew Thompson, Buford, GA (US); James Jonathan Holbrook, Cumming, GA (US); Sten Hallundbaek Mejenborg, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 15/394,023

(22) Filed: Dec. 29, 2016

(65) Prior Publication Data

US 2018/0186554 A1 Jul. 5, 2018

(51) Int. Cl.
*B65D 83/12* (2006.01)
*B65D 83/08* (2006.01)

(52) U.S. Cl.
CPC ..... *B65D 83/0841* (2013.01); *B65D 83/12* (2013.01)

(58) Field of Classification Search
CPC ..... G07F 17/329; G07F 11/002
See application file for complete search history.

(56) References Cited

U.S. PATENT DOCUMENTS 3,894,669 A * 7/1975 Wescoat ..... B65H 35/10 225/103
5,100,038 A * 3/1992 Schafer ..... A47K 10/426 225/32
5,287,980 A * 2/1994 Saltz ..... G07B 3/04 206/509
6,053,358 A * 4/2000 Tong ..... B65H 29/12 221/151
7,665,394 B2 * 2/2010 Roberts ..... G07F 11/68 221/1
9,613,337 B1 * 4/2017 Garrison ..... G07F 11/002
2004/0000572 A1 1/2004 Engelhardt, Jr. et al.
2005/0178810 A1 * 8/2005 Woods ..... G07F 11/68 225/1
2006/0016826 A1 * 1/2006 Jensen ..... G07F 17/42 221/199
2007/0204737 A1 * 9/2007 Finkenbiner ..... B65H 35/002 83/649
2014/0046481 A1 * 2/2014 Siciliano ..... G07F 11/002 700/236
2016/0331192 A1 * 11/2016 Rubenson ..... A47K 10/36
2017/0018148 A1 * 1/2017 Behm ..... G07F 17/42

* cited by examiner

*Primary Examiner* — Timothy R Waggoner
(74) *Attorney, Agent, or Firm* — Dority & Manning, P.A.

(57) ABSTRACT

A lottery ticket dispenser array includes a plurality of separate ticket bins, wherein each bin defined by a housing that defines an internal space for receipt of a supply of interconnected lottery tickets. Each bin has an electronic drive mechanism that dispenses the lottery tickets therefrom. A slot is defined in the back side of each bin housing through which the lottery tickets are dispensed from the internal space. An upper tear bar is configured adjacent an upper side of the slot, and a lower tear bar is configured adjacent a lower side of the slot. Once a lottery ticket is dispensed by the drive mechanism through the slot, the ticket is separated by pulling the lottery ticket upward against the upper tear bar or downward against the lower tear bar.

15 Claims, 4 Drawing Sheets

SMART BIN LOTTERY TICKET DISPENSER WITH DUAL TEAR BARS

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

The typical scratch-off lottery tickets are delivered to retail establishments in the form of an interconnected strip in a fan-fold or rolled configuration, wherein perforation lines define individual tickets. In this regard, the individual dispensing bins must be equipped with a mechanism for separating the tickets in a reliable and repeatable manner. Failure of the final ticket separation process can be costly. For example, if the dispenser does not separate a ticket exactly along the perforation, the ticket may be "unsellable" or information needed for verification can be separated from the ticket and lost.

Various ticket separation devices are known or have been proposed in the industry. For example, U.S. Pat. Pub. No. 2004/0000572 describes a lottery ticket dispenser that utilizes a separator shaft having helical blades mounted thereon. The separator shaft is driven by a motor and is adjacent the infeed drive rollers in the drive mechanism for separating the lottery tickets along their perforation line.

The use of a tear bar situated adjacent to a dispensing slot in the bin is also known as a cost-effective and relatively simple separation mechanism. However, the conventional tear bar configuration can be problematic when a ticket dispenser array includes a relatively large matrix of individual bins, for example an array with bins stacked four or five high. Depending on a height location of the array in a retail establishment, the retail clerk may need to reach upwards for grasping and detaching tickets from the upper bins, or may need to reach downwards to grasp and detach tickets from the lower bins. With known tear bar a configuration, a single tear bar is provided adjacent to the dispensing slot. If this single tear bar is located at the upper side ("upper lip") of the dispensing slot, it becomes ineffective if the clerk must reach up and apply a downward force to separate the ticket along its perforation line. In this situation, because the tear bar is essentially not used, the clerk must be careful and hope that the ticket separates along the perforation line with the downward pulling force without tearing the ticket or pulling subsequent tickets from the dispenser. Likewise, if the single tear bar is located at the lower lip of the dispensing slot, it is ineffective if the clerk must reach down and apply an upward force to separate the ticket along its perforation line. Again, the clerk must hope that the ticket will not tear or cause other tickets to be pulled from the dispenser.

The present invention provides an improvement to tear bar configurations in lottery ticket dispensers that addresses the above problem.

SUMMARY

Objects and advantages of the invention will be set forth in part in the following description, or may be obvious from the description, or may be learned through practice of the invention.

In accordance with aspects of the invention, a lottery ticket dispensing array is provided for dispensing instant or other preprinted lottery tickets at a retail establishment. The type of retail establishment may vary widely within the scope and spirit of the invention. For example, in certain embodiments, the retail establishments may be convenience stores, gas stations, pubs, and any other establishment that typically sells lottery tickets to the public. The present array has particular usefulness for much larger retail establishments, such as "big-box" retail stores that are part of a national or other geographic chain, wherein the sale of lottery ticket sales has generally not been implemented.

The lottery ticket dispenser array includes a plurality of separate bins, for example an array of 3×4 separate bins, wherein each bin is defined by a housing having a front side that faces a purchaser in operational use of the dispenser array, an opposite back side that faces the retail vendor or clerk. Each bin has a defined first internal space for receipt of a first supply of interconnected lottery tickets (e.g., a roll or fan-folded stack of tickets). Each bin may contain a supply of different scratch-off lottery ticket games, or two or more bins may contain a respective supply of tickets for the same game.

Each bin in the array has an electronic drive mechanism that dispenses the lottery tickets therefrom. A slot is defined in the back side of each bin through which the lottery tickets are dispensed from the internal space by the drive mechanism.

Each bin includes an upper tear bar configured adjacent an upper side of the slot, and a separate lower tear bar configured adjacent a lower side of the slot. With this unique configuration, once a lottery ticket is dispensed by the drive mechanism through the slot, the dispensed lottery ticket is separated by pulling the lottery ticket either upward against the upper tear bar or downward against the lower tear bar. The individual tear bars may be variously configured, as discussed below.

In certain embodiments, the lottery ticket dispenser includes a control system configured with each bin. A respective sensor subsystem is configured within the ticket path to detect the separation of the dispensed ticket, with the sensors in communication with the control system. The sensors may be any suitable manner of electrical, mechanical, or electro-mechanical sensor that detects the ticket separation and removal from the bin. For example, the tear bar may be mounted so as to deflect or move a small amount upon engagement by the lottery ticket, wherein the sensor is a mechanical or electro-mechanical switch-type sensor that detects such displacement. Or, the sensor may be an optical sensor that detects a ticket's presence. It should be appreciated that various known sensors and sensor principles may be utilized in this regard.

The control system can be variously configured. In one embodiment, the control system may be a single system that is common to all of the bins in the array. In another embodiment, the control system may be an individual control system for each bin. For example, the control system may be implemented by logic circuitry on a control board within each bin.

In certain embodiments, the control system (whether an individual system or common system) is in communication with a central lottery provider server system, wherein the central server system uses information from the control system indicating that a ticket has been dispensed and removed for any manner of administrative or functional purpose, such as security/fraud detection, accounting of tickets distributed to retail locations, invoicing of tickets, and so forth.

Since the control system maintains positive control over the position of the leading edge of the ticket, in certain embodiments, the tear bar may assume the form a curvilinear surface (e.g., instead of a serrated edge or blade edge). The radius of this curve also affects the performance of the ticket separation action. Optimal ease of separation of the tickets along the line of perforation has been found to correspond to a radius of approximately 1 mm. If the control of the position of the leading edge of the ticket were less precise, then a larger radius would be necessary.

Use of the curved surface facilitates the application of the separation tension along the line of perforation. This force has two component vectors, where one is parallel to the tangent of the curved surface and perpendicular to the line of perforation and the other is parallel to the line of perforation. This facilitates the "unzipping" of the perforation.

Contrast this to the operation of a conventional tear bar where the separation force is primarily applied normal, as opposed to tangential, to the horizontal plane of the paper. In such an arrangement the location of the perforation relative to the leading edge of the tear bar is even more critical to assure that separation occurs at the line of perforation.

It should be appreciated that the architecture of the individual bins can vary within the scope of the invention. For example, in one embodiment, the back side of the bin includes a pivotal door that opens to the internal space for loading of the supply of lottery tickets into the bin, wherein the dispensing slot is defined in the pivotal door and the upper and lower tear bars are mounted on the pivotal door. The respective tear bar sensors may also be mounted on the pivotal door.

The present invention encompasses a stand-alone individual lottery ticket bin as described herein.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
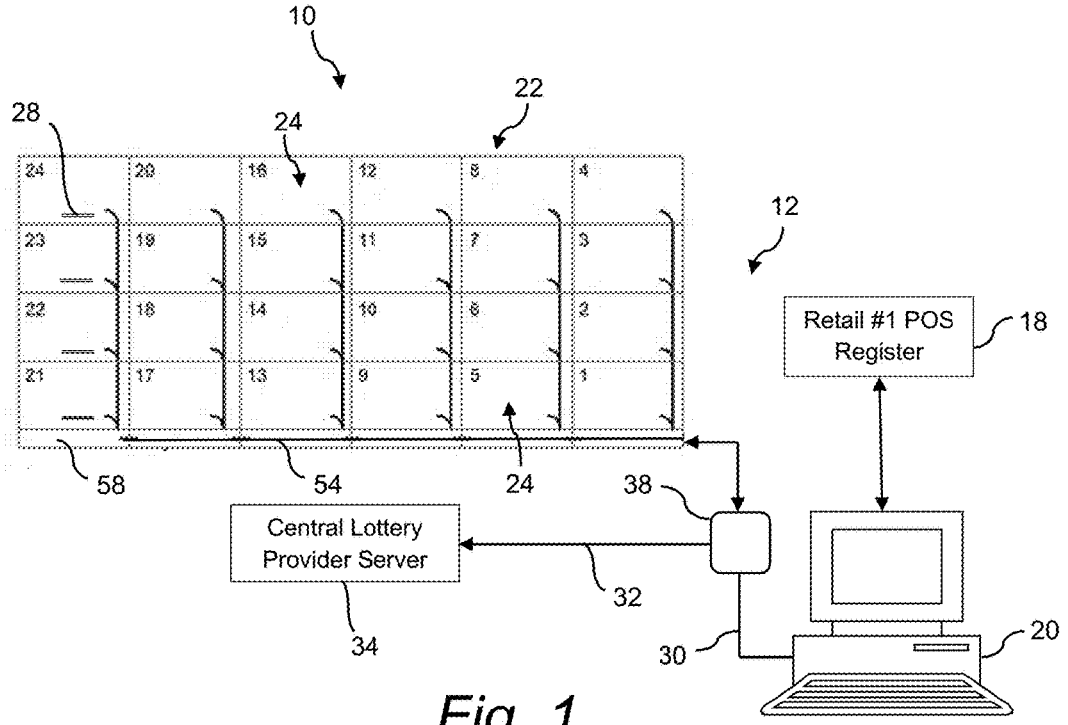
FIG. 1 is a block diagram of a lottery ticket dispenser in accordance with aspects of the present invention.

FIG. 1 depicts an embodiment of a system 10 and related methodology for dispensing lottery tickets 14 at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention. Although not limited to such, the present system 10 has particular usefulness for larger retail establishments, such as "big-box" retail stores that are part of a national or other geographic chain.

The retail establishment 12 includes one or more retail point-of-sale (POS) registers 18 wherein patrons of the establishment 12 purchase goods. Typically, a scanner is associated with the POS register 18 to scan a UPC code on the products, with the UPC code linked to a purchase price and identification of the products, as is well-known in the art.

Figure 3:
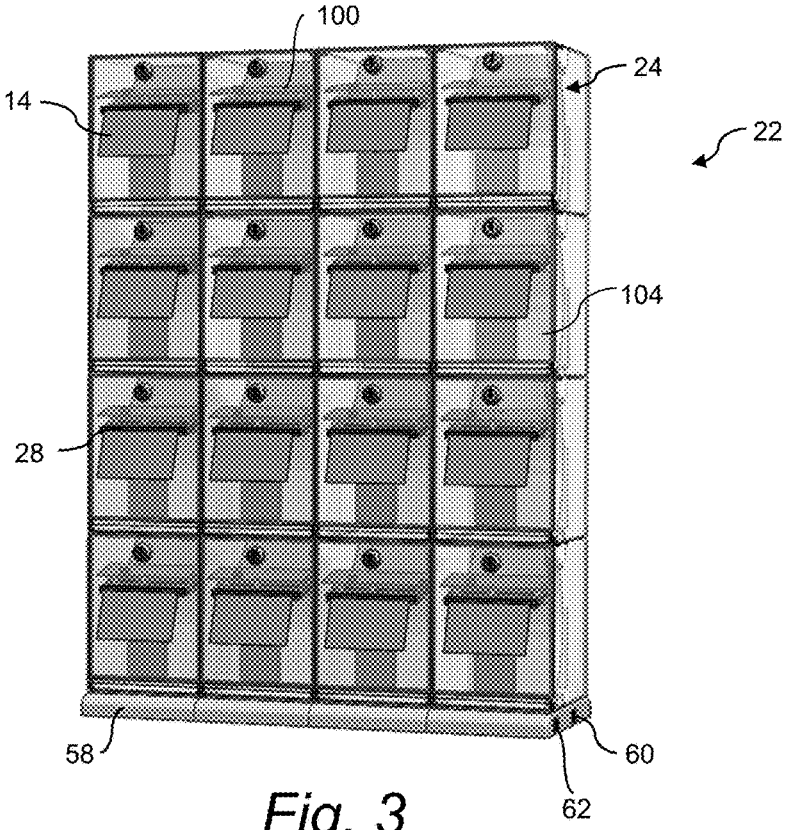
FIG. 3 is a back perspective view of an embodiment of a lottery ticket dispenser.

In the embodiment of FIG. 1, a lottery ticket terminal 20 is configured in wired or wireless communication with the retail POS register 18 to accept a request for purchase of a particular lottery ticket 14 (FIG. 3) selected from a plurality of different lottery tickets made available to patrons for purchase. This request may be input directly to the terminal 20 or come via the POS register 18. The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Ga., USA, offers Flair™ and Wave™ lottery ticket terminals that may be readily configured by those skilled in the art for a system as described herein.

A patron's request for a particular scratch-off lottery ticket may be input into the lottery ticket terminal 20 by a retail clerk or other employee of the retail establishment 12 by various means. For example, the terminal 20 may be configured with a scanner, wherein the clerk scans a "master" card having a code corresponding to the particular lottery ticket 14 requested by the patron. Thus, a master card or master code would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Still referring to the embodiment of FIG. 1, a "smart" lottery ticket dispenser array 22 is in wired or wireless communication with the terminal 20. This dispenser array includes one or a plurality of individual lottery ticket bins 24, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

Each lottery ticket 14 in the different bins includes a machine readable code printed on a front or back side thereof, such as an alpha-numeric code, bar code, QR code, or the like. The type of code may vary depending on the desired information content of the code, space on the ticket 14, and so forth. The use of such codes on lottery tickets 14 for various functions related to inventory, identification, verification, and security are well-known. In accordance with aspects of the invention, the lottery tickets in each bin 24 are generally loaded as a fan-folded or roll of sequentially numbered tickets, wherein the machine readable code on each lottery ticket 14 contains this number (as well as any manner of additional ticket information), for example in the form of a serial number embedded in the code.

Referring to the figures in general, each bin 24 in the dispenser array 22 includes an electronic drive mechanism 26 that, when activated, dispenses one or more lottery tickets 14 from the bin 24 (depending on the number of tickets requested by the patron). This drive mechanism 26 may include a motor that drives a friction roller, wherein the tickets 14 are engaged between the friction roller and an idler roller (which may be spring-biased against the friction roller) such that driven rotation of the friction roller causes the tickets 14 to be advanced through a dispensing slot 28 in a wall of the individual bin 24. The drive mechanism 26 may also include a sensor 106 (FIG. 5) that detects a leading and/or trailing edge of adjacent tickets 14 so as to control the run time of the drive mechanism 26 to ensure that perforations between the tickets 14 are presented at a tear bar adjacent to the dispensing slot, as discussed in greater detail below. For example, such a sensor may be an optical sensor that detects the perforation line between adjacent tickets. Alternately, the friction or idler roller may include an electrical or mechanical encoder that indirectly measures the length of a ticket passing between the rollers as a function or rotations of the roller. In another embodiment, a timing circuit may control the dispense cycle as a function of run time of the motor. It should be appreciated that the drive mechanism 26 may be variously configured to perform the functions of dispensing the requisite number of tickets 14 from the individual respective bin 24 within the scope and spirit of the invention.

In the illustrated embodiments, each bin 24 also includes a scanner 40 disposed so as to read the code on the lottery tickets 14 as they are dispensed from the bin 24. The scanner 40 may be any conventional barcode reader, such as a point scanner, linear scanner, laser scanner, LED image scanner, and so forth. The tickets 14 are loaded into the bins 24 such that the code printed on each ticket passes within the detection field of the scanner 40. An integral (or separate) reader is configured with the scanner 40 to decode the scanner signal.

The architecture of each bin 24 and the array 22 in general can vary within the scope of the invention. Referring to FIGS. 1 through 6, the dispenser array 22 includes a bottom row of bins 24 having interconnected base structures 58. For example, each base structure 58 may include a male power plug and male data plug along one side, and a female power port 60 and female data port 62 along the opposite side. The plugs and ports of adjacent base structures 58 interconnect to essentially define a data bus 54 (FIGS. 1 and 2) running the length of the base structures 58. An exposed power port 60 and data port 62 at one of the ends of the interconnected base structures is available for connection with a power cord and a data cord from the system control system 38 or lottery terminal 20.

Figure 5:
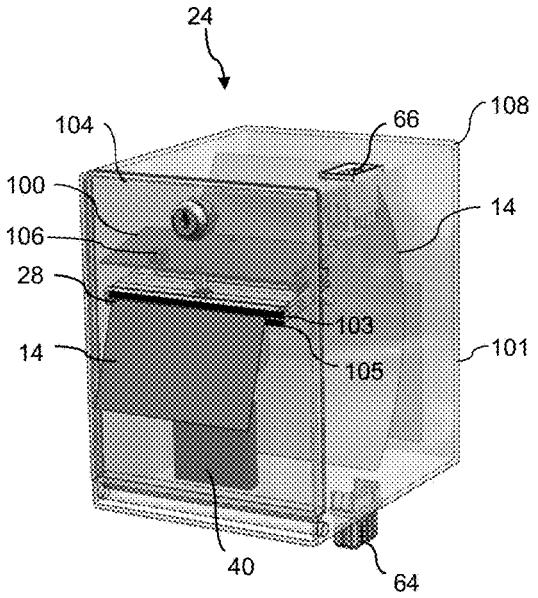
FIG. 5 is a front perspective view of a lottery ticket bin in accordance with the invention.
Figure 6:
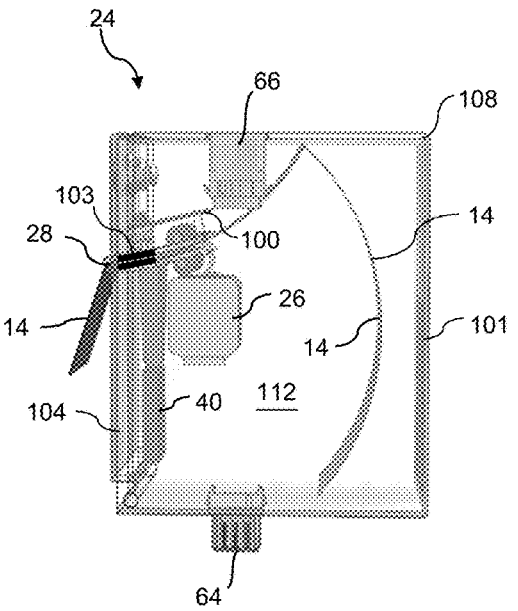
FIG. 6 is a side view of the bin embodiment of FIG. 5.

Referring to FIGS. 5 and 6 in particular, each of the individual bins 24 includes a multi-sided housing 108 defining an internal space 112 in which the stack or roll of lottery tickets 14 is stored. In the depicted embodiments, the housing 108 is a box-like member having top and bottom walls, side walls, a front wall 101, and a pivotal back wall or door 104. The back wall 104 swings open to provide access into the housing 108 for loading the ticket stack. The dispensing slot 28 may be defined in this wall 104, with the tear bars 103, 105 and respective sensors 107, 109 also mounted to the pivotal wall 104. The scanner 40, electronic drive mechanism 26, control board 100, and edge detector 106 may all be mounted on the pivotal wall 104 as well, as shown in FIGS. 5 and 6.

Figure 4:
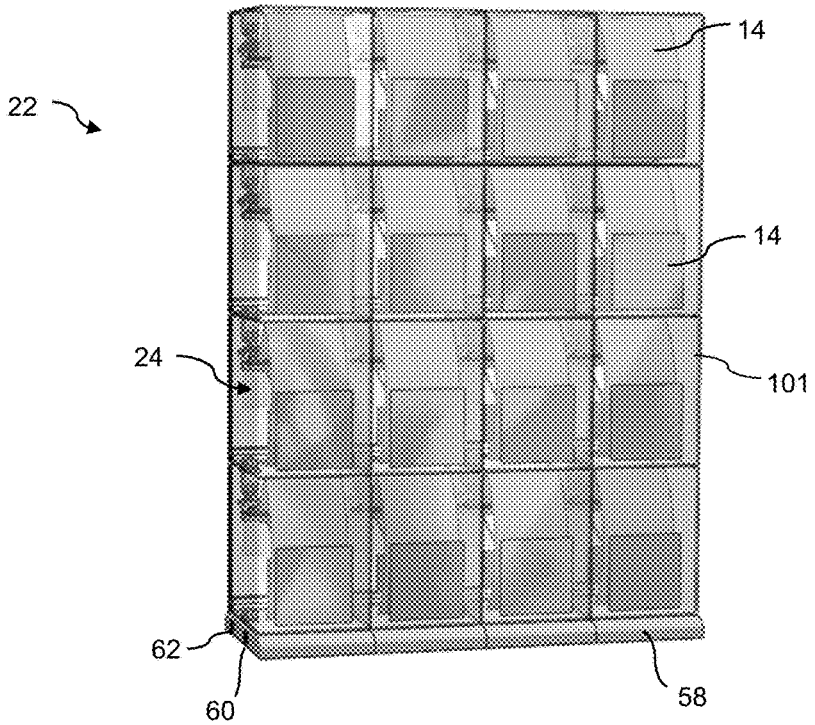
FIG. 4 is a front perspective view of the lottery ticket dispenser of FIG. 3.

As shown in FIG. 4, each bin 24 may include a sample ticket 14 or other identifying insert attached to a front face of the bin 24 that faces the patrons so that the patron is aware of the exact tickets available for purchase. Each bin 24 includes a male power/data connector 64 on the top or bottom surface, and a corresponding female power/data connector 66 on the opposite surface, as seen in FIGS. 5 and 6. With this configuration, a plurality of the bins 24 can be vertically stacked and interconnected, as depicted in the various figures.

Figure 7:
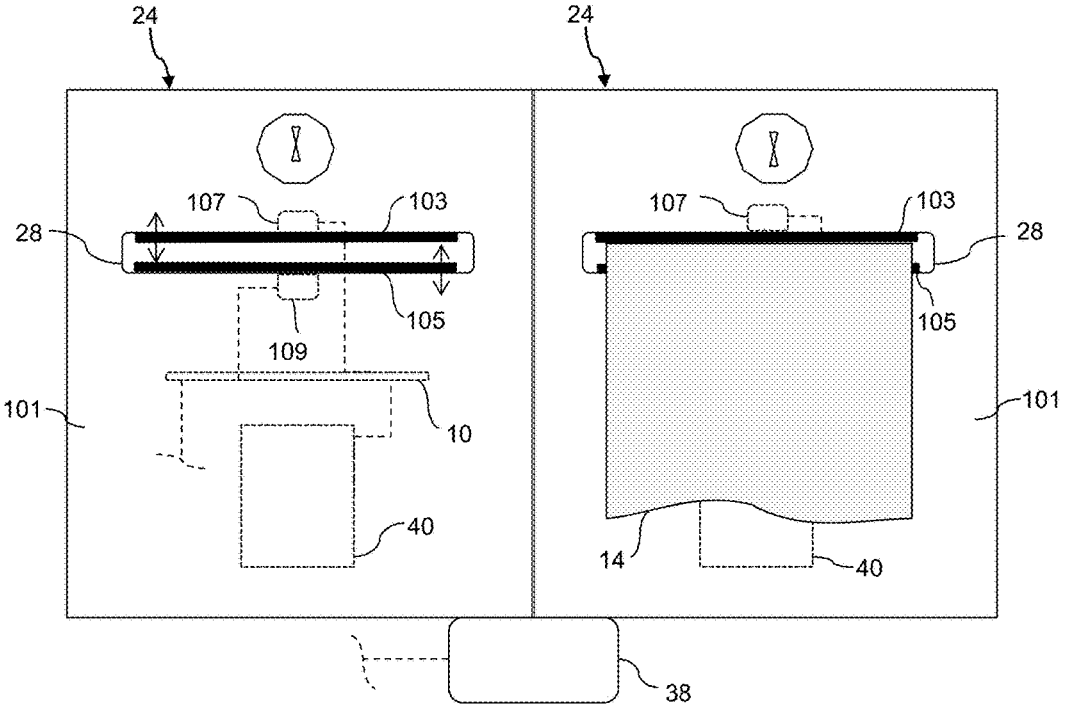
FIG. 7 is a diagram view of the front side of adjacent lottery ticket bins in accordance with aspects of the invention.

Referring to FIGS. 5 through 7 in general, each bin 24 in the array 22 includes an upper tear bar 103 mounted adjacent an upper side or "lip" of the dispensing slot 28, and a separate lower tear bar 105 mounted adjacent a lower lip of the slot 28. These tear bars 103, 105 may have a serrated edge profile, knife edge profile, or a combination of both, and serve to sever the lottery tickets 14 along the perforation line between adjacent tickets when the tail of a ticket 14 that has been dispensed out of the slot 28 is grasped and pulled against the tear bar 103, 105. Because an upper 103 and lower 105 tear bar are presented at the dispensing slot 28, the user has the option to pull the ticket 14 upwards against the upper tear bar 103 or downwards against the lower tear bar 105.

Figure 8:
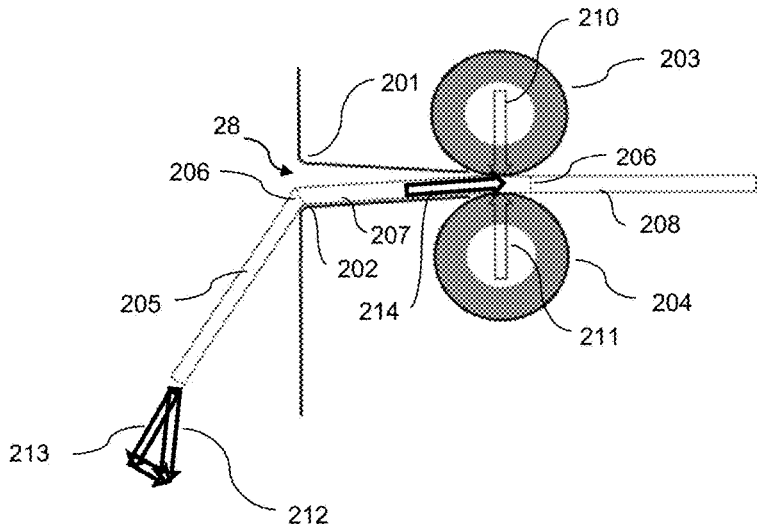
FIG. 8 is a vertical section diagram view of the ticket path through the dispenser between the friction roller and the slot in the rear wall through which the ticket stock exits.

In an alternative embodiment the tear bars are configured as an upper and lower curvilinear surface, as depicted in FIG. 8. These curvilinear surfaces may be defined in structure through which the tickets pass, such as upper and lower guide plates that define the slot 28. Thus, it should be understood that the term "tear bar" includes opposed surfaces against which the ticket 14 can be engaged for separation, regardless of the structure defining the surfaces. Referring to FIG. 8, the upper curvilinear surface 201 is defined on a member, such as an upper guide plate, that extends inside the housing to the vicinity of the upper roller 203 of the drive roller pair. Similarly, the lower curvilinear surface 202 is defined on a member, such as a lower guide plate, that extends into the housing to the vicinity of the lower 204 of the drive roller pair. The lead ticket 205 is shown exiting the housing through the slot 28, which may be defined by the upper and lower guide plates. Alternatively, the curvilinear surfaces may be defined on the housing wall that defines the slot 28. Two lines of perforation 206 are shown between three adjacent tickets 205, 207 and 208.

When being dispensed, a ticket is positioned with its line of perforation 206 directly above the curve in the lower surface 202. Then the driven friction roller 204 is stopped.

The opposed idler roller 203 may be spring loaded and generates a downward force 210 on the ticket 207 passing between the rollers. To separate the dispensed ticket 205 from the ticket 207 held in place by the rollers, the clerk simply applies a force 212 to the dispensed ticket which folds down the ticket and places it in tension (indicated by arrow 213). This tensile force 213 force is opposed by the force 214, which can be a maximum of the friction roller's normal force 211 multiplied by the static coefficient of friction of the friction roller's interface with the front of the ticket. When the tensile force 213 exceeds the perforation strength of the line of perforation 206, the ticket 205 will separate cleanly, along the line of perforation 206, from ticket 207. Note that the clerk could have also applied a force to fold the ticket upward against the upper curvilinear surface 201 and achieved a similarly clean ticket separation.

Figure 9:
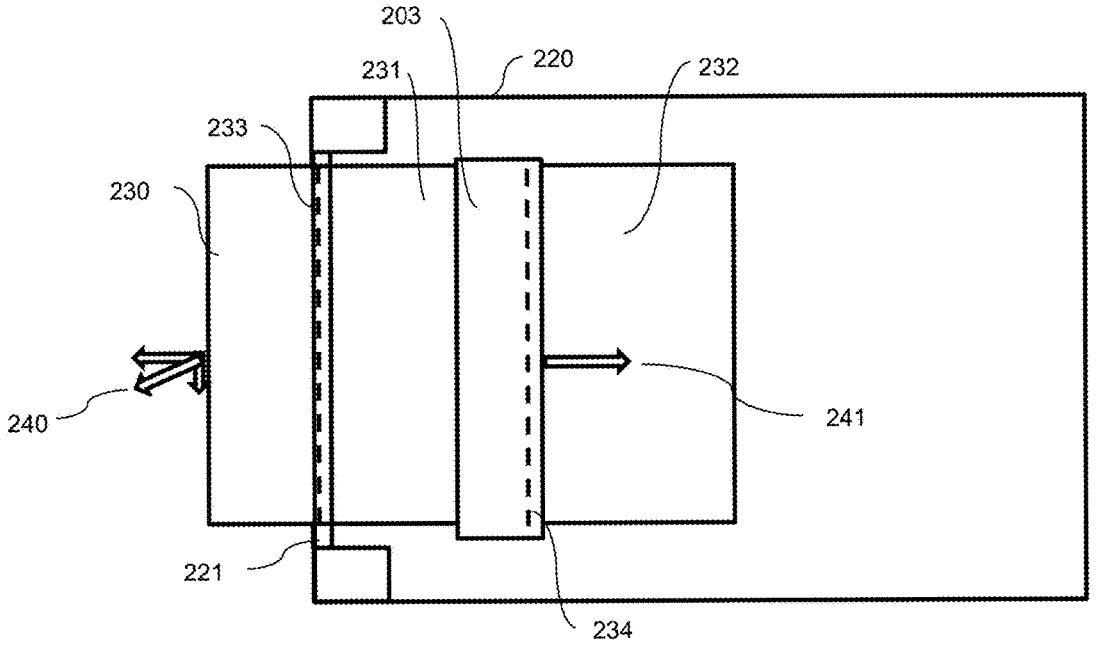
FIG. 9 is a horizontal section diagram view of the ticket path through the dispenser just above the exit plane of the ticket.

FIG. 9 is a top view of the dispensed ticket where a horizontal section 220, just above the plane of the paper path is presented. Three interconnected tickets, 230, 231 and 232 are depicted, the tickets separated by two lines of perforation 233 and 234. The upper roller 203 is seen holding the middle ticket in place. The line of perforation 233 is shown positioned over the lower curved surface 221. To separate the ticket the clerk simply applies a force 240 at a slight horizontal angle to the centerline of the dispenser. This force is opposed by the holding force 241 of the rollers 204, 203. When the force 240 exceeds the perforation strength of the line of perforation, 233, the perforation will simply "unzip", resulting in the clean separation of ticket 230 from ticket 231.

In the depicted embodiments, lottery ticket dispenser includes a control system 28 configured with each bin 24 (discussed in greater detail below). A respective sensor 107, 109 is configured with each of the upper and lower tear bars 103, 105, with the sensors 107, 109 in communication with the control system 38. The sensors 107, 109 may be any suitable manner of electrical, mechanical, or electro-mechanical sensor that detects the separation of the dispensed ticket 14 and its removal from the bin 24. For example, the tear bars 103, 105 may be mounted with vertically oriented slots that allow the tear bars 103, 105 to deflect or move a small amount (indicated by the double arrows in FIG. 7) upon engagement by the lottery ticket 14. The sensors 107, 109 may be contact or proximity sensors that detect such displacement and generate a corresponding signal to the control system 38. Thus, it should be appreciated that the sensors 107, 109 may be any manner of suitable electrical, mechanical, or electro-mechanical sensor that detects such ticket separation and removal event. The sensors 107, 109 may be an optical sensor that detects such an event. It should be appreciated that various known sensors and sensor principles may be utilized in this regard.

The scanner 40 may also be configured to sense the presence of a ticket 14 and the position of its leading edge. In such an embodiment the scanner 40 may include the sensor subsystem functionality. This would reduce the dispenser's parts count and cost and improve its reliability.

Referring for example to FIGS. 1 and 7, the control system 38 may be a central system that is common to (and in communication with) all of the bins 24 in the array for performing the functions discussed herein. This central control system 38 may be physically configured with the array 22 (e.g., within a base structure) or may be remote from the array 22.

Figure 2:
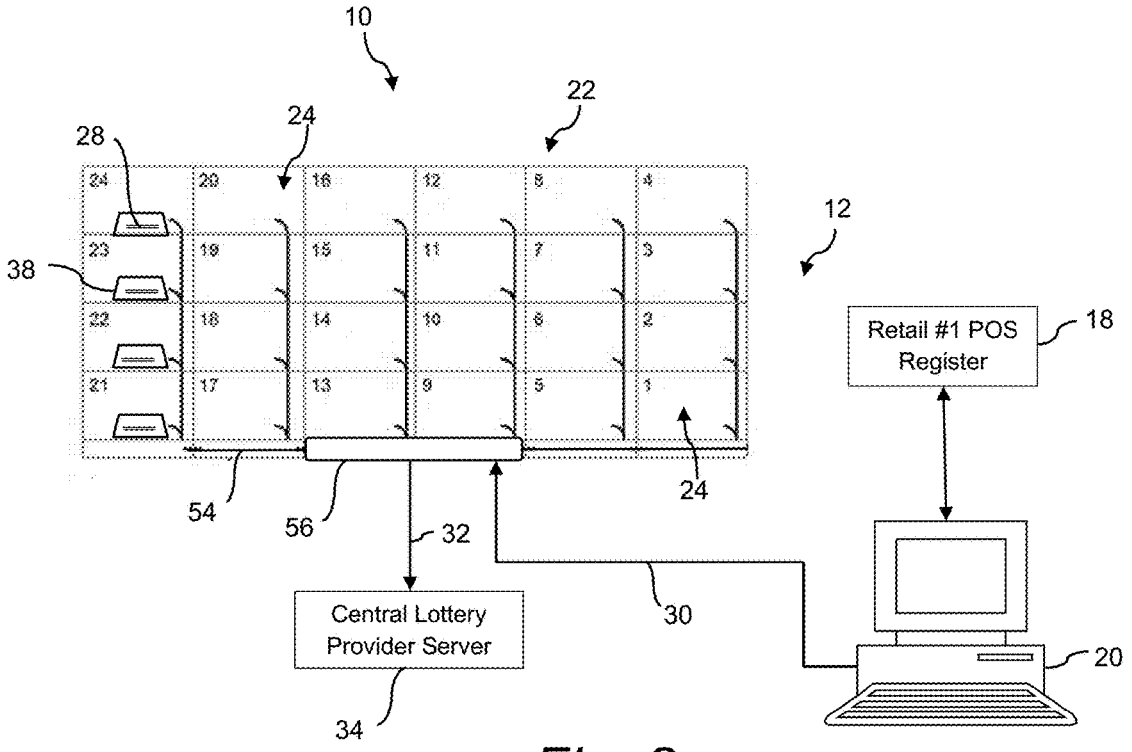
FIG. 2 is a block diagram of another embodiment of a lottery ticket dispenser in accordance with aspects of the present invention.

In another embodiment, the control system 38 may be an individual system configured with each bin 24. For example, referring to FIGS. 5 through 7, each bin 24 may include a control board 100 having logic circuitry to control the various components within the bin 24, such as the leading edge sensor 106, electronic drive mechanism 26, scanner 40, and so forth. Any manner of control or power components can be mounted on the board 100 for operation of the individual bins 24 as described herein. FIG. 2 depicts individual control systems 38 for each bin 24 in direct communication with the terminal 20 via a signal router 56 integrated with the dispenser array 22. This router 56 routes the purchase signal 30 from the lottery ticket terminal 20 to the correct bin 24.

Referring to the system of FIGS. 1 and 2, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to an individual control system 38 associated with the bin 24 (FIG. 2), or to a common control system 38 associated with all of the bins 24 (FIG. 1), to activate the drive mechanism 26 and dispense the requisite number of lottery tickets 14 from the bin 24. Signals from the leading edge sensor 106 or scanner 40 are used provide accurate control over the position of the leading edge of each ticket.

In an alternate embodiment, the purchase signal 30 is generated by the POS register 18 and transmitted to the control system 38 after the POS register 18 receives a purchase code from the lottery ticket terminal 20 corresponding to the particular ticket requested by the patron.

The system 10 may include a central lottery server 34 that is common to a number of different retail establishments 12. As described above, as the tickets 14 are dispensed from the bin 24, the scanner 40 reads the code printed on each ticket or, alternatively, the first and last codes printed on sequentially dispensed tickets, and the tear bar sensors 107, 109 detect a ticket separation cycle. A signal 32 from the control system 38 containing the scanned code and tear bar sensor data may be routed to the central lottery server 34 for each lottery ticket dispensed from the dispenser array 22 to enable certain actions relevant to the sale, dispensing, verification, accounting of the individual tickets 14. For example, the central lottery server 34 may include a database of all tickets delivered to the respective retail establishments 12, and the near instantaneous identification of dispensed/sold lottery tickets 14 to the server 34 enables various desired functionalities. For example, the individual lottery tickets 14 may remain "inactive" in the lottery provider's system (and thus unable to be redeemed) until individually activated by the central lottery server 34 as they are dispensed and sold. Thus, fraudulently obtained tickets (e.g., stolen or otherwise illegally obtained) cannot be redeemed. This is contrary to a conventional practice of activating entire books ("packs") of tickets upon delivery to a retail establishment 12.

The present system also 10 allows for enhanced accountability of lottery tickets 14 sold at a particular retail establishment 12 by logging each ticket as it is sold and dispensed. The number of tickets 14 sold during a work shift (or other time period) is easily determined by generating a report by the central server 34 of the tickets sold at any of the retail establishments during any defined time period. The number of tickets 14 sold at any of the retail establishments 12 can be readily reconciled with tickets delivered to the establishment. Likewise, the number of tickets 14 dispensed during a defined time can be readily and electronically reconciled with reported purchase transactions from the respective establishment 12, with discrepancies being immediately identified for further investigation.

Another particular advantage of the system 10 and associated method is that billing practices between the retail establishments 12 and lottery authority, the lottery service provider, or ticket manufacturer can be based on real-time sales of the lottery tickets 14. For example, the retail establishments 12 can be invoiced on a periodic basis (e.g., daily or weekly) for the actual number of tickets sold (dispensed) at each respective establishment based on the signals 32 routed to the central lottery server 34 instead of upon delivery, or other payment methodology typically in use today. These include but are not limited to consignment for a predetermined time period, or estimate of sales based on the number of winning tickets cashed from a pack of tickets being sold.

It should be appreciated that the terms "server" is used herein to encompass any configuration of computer hardware and software that is maintained by a lottery authority or game provider to carry out the functionalities of the present system 10 and associated method, as well as any manner of additional lottery functions known to those skilled in the art. It should be readily appreciated that the server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. Generally, the server 34 is configured to communicate with, manage, execute and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 10.

The server 34 may be directly or indirectly connected through an I/O bus to any manner of peripheral devices such as storage devices, wireless adaptors, printers, and the like. In addition, a database (DB) may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, and so forth.

It should be appreciated that embodiments of the methods and systems 10 disclosed herein may be executed by one or more suitable networked lottery gaming components and establishment components (e.g., POS register 18, back office server, and so forth) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser array, comprising:

a plurality of separate bins, each bin defined by a housing having a front side that faces a purchaser in operational use of the dispenser array, an opposite back side, and an internal space for receipt of a supply of interconnected lottery tickets;

each bin having an electronic drive mechanism that dispenses the lottery tickets therefrom, wherein adjacent lottery tickets are separated by a perforation line;

a slot defined in the back side of each bin through which the lottery tickets are dispensed from the internal space;

an upper tear bar configured adjacent an upper side of the slot;

a lower tear bar configured adjacent a lower side of the slot;

the drive mechanism configured to convey the lottery tickets through the slot until the perforation line between adjacent lottery tickets is aligned with the upper and lower tear bars;

wherein once a lottery ticket is dispensed by the drive mechanism through the slot, the dispensed lottery ticket is separated by pulling the perforation line in the lottery ticket upward against the upper tear bar or downward against the lower tear bar while the drive mechanism applies a retarding force to an upstream lottery ticket adjacent the dispensed lottery ticket; and a first sensor disposed with the upper tear bar, and a second sensor disposed with the lower tear bar, wherein the first and second sensors are configured to detect physical separation of a lottery ticket by the respective upper or lower tear bar for each ticket dispensed from the bin.

2. The lottery ticket dispenser as in claim 1, further comprising a control system configured with each bin, the first and second sensors in communication with the control system to indicate that the lottery ticket has been dispensed and removed from the bin.

3. The lottery ticket dispenser as in claim 2, wherein the first and second sensors are one of an electrical sensor, mechanical sensor, or electro-mechanical sensor that detects the separation of the ticket being dispensed.

4. The lottery ticket dispenser as in claim 2, wherein the control system is common to all of the bins in the array.

5. The lottery ticket dispenser as in claim 2, wherein the control system is an individual control system for each bin.

6. The lottery ticket dispenser as in claim 1, wherein the control system is in communication with a central lottery provider server system.

7. The lottery ticket dispenser as in claim 1, wherein the back side of the bin comprises a pivotal door that swings open to the internal space for loading of the supply of lottery tickets into the bin, the slot defined in the pivotal door, the upper and lower tear bars mounted on the pivotal door, and the first and second sensors are mounted on the pivotal door.

8. The lottery ticket dispenser as in claim 1, wherein the tear bars are configured as upper and lower curvilinear surfaces.

9. A lottery ticket dispenser array, comprising:

a plurality of separate bins, each bin defined by a housing having a front side that faces a purchaser in operational use of the dispenser array, an opposite back side, and an internal space for receipt of a supply of interconnected lottery tickets;

each bin having an electronic drive mechanism that dispenses the lottery tickets therefrom, wherein adjacent lottery tickets are separated by a perforation line;

a slot defined in the back side of each bin through which the lottery tickets are dispensed from the internal space;

an upper tear bar mounted to the back side of the housing adjacent an upper side of the slot, the upper tear bar deflectable relative to the back side of the housing;

a lower tear bar mounted to the back side of the housing adjacent a lower side of the slot, the lower tear bar deflectable relative to the back side of the housing;

the drive mechanism configured to convey the lottery tickets through the slot until the perforation line between adjacent lottery tickets is aligned with the upper and lower tear bars;

wherein once a lottery ticket is dispensed by the drive mechanism through the slot, the dispensed lottery ticket is separated by pulling the perforation line in the lottery ticket upward against the upper tear bar or downward against the lower tear bar causing deflection of the upper or lower tear bar while the drive mechanism applies a retarding force to an upstream lottery ticket adjacent the dispensed lottery ticket; and a first sensor disposed with the upper tear bar to detect deflection of the upper tear bar, and a second sensor disposed with the lower tear bar to detect deflection of the lower tear bar upon each lottery ticket being dispensed from the bin.

10. The lottery ticket dispenser as in claim 9, further comprising a control system configured with each bin, the first and second sensors in communication with the control system to indicate that the lottery ticket has been dispensed and removed from the bin.

11. The lottery ticket dispenser as in claim 9, wherein the first and second sensors are one of an electrical sensor, mechanical sensor, or electro-mechanical sensor that detects the deflection of the upper or lower tear bars.

12. The lottery ticket dispenser as in claim 9, wherein the control system is common to all of the bins in the array.

13. The lottery ticket dispenser as in claim 9, wherein the control system is an individual control system for each bin.

14. The lottery ticket dispenser as in claim 9, wherein the control system is in communication with a central lottery provider server system.

15. The lottery ticket dispenser as in claim 9, wherein the back side of the bin comprises a pivotal door that opens to the internal space for loading of the supply of lottery tickets into the bin, the slot defined in the pivotal door, the upper and lower tear bars mounted on the pivotal door, and the first and second sensors mounted on the pivotal door.

* * * * *